US006280832B1

(12) United States Patent
Heyse

(10) Patent No.: US 6,280,832 B1
(45) Date of Patent: Aug. 28, 2001

(54) COMPONENT PRODUCED BY MICRO-ELECTRODEPOSITION

(75) Inventor: Jörg Heyse, Markgröningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/142,322

(22) PCT Filed: Nov. 19, 1997

(86) PCT No.: PCT/DE97/02708

§ 371 Date: Sep. 4, 1998

§ 102(e) Date: Sep. 4, 1998

(87) PCT Pub. No.: WO98/33958

PCT Pub. Date: Aug. 6, 1998

(30) Foreign Application Priority Data

Jan. 29, 1997 (DE) ..... 197 03 080

(51) Int. Cl.[7] ..... B32B 7/02

(52) U.S. Cl. ..... 428/213; 428/220; 428/312.8; 428/209

(58) Field of Search ..... 428/195, 209, 428/213, 220, 312.8, 332; 29/527.1, 527.2, 527.3; 264/219, 220

(56) References Cited

FOREIGN PATENT DOCUMENTS

| | | | |
|---|---|---|---|
| 44 32 725 | | 1/1996 | (DE) . |
| 1 96 07 288 | | 10/1996 | (DE) . |
| 567 332 | | 10/1993 | (EP) . |
| 0567332 | * | 6/1996 | (EP) . |
| 63-290285 | | 11/1988 | (JP) . |

* cited by examiner

*Primary Examiner*—Merrick Dixon
(74) *Attorney, Agent, or Firm*—Kenyon & Kenyon

(57) ABSTRACT

Component having several plates or working layers which are built upon one another by microdeposition. At least one code mark which is produced during electroplating and can be evaluated from the outside through optical means, is provided in at least one of the working layers forming an outer edge of the component. In the form of a perforated disk, the component is suitable for use in injection valves, in ink-jet printers, for spraying or injecting fluids, or for atomizing medicines.

10 Claims, 3 Drawing Sheets

COMPONENT PRODUCED BY MICRO-ELECTRODEPOSITION

FIELD OF THE INVENTION

The present invention relates to a microplated component.

BACKGROUND INFORMATION

Conventional microplated components, used in the form of perforated disks in injection valves or for the production of fine sprays in general, e.g. with large spraying angles, are already known from German Patent No. 196 07 288. The individual plates, or working layers, of the perforated disk are built upon one another by electrodeposition (multilayer electroplating). The plates are electrodeposited consecutively so that the subsequent plate adheres firmly to the underlying plate due to electrical bonding, and all layers together then form a one-piece perforated disk. To make a large number of perforated disks easier to handle when applying the various manufacturing process steps to a wafer, two positioning receptacles, e.g. in the form of circular through holes, are provided close to the outer edge of the perforated disk and extend along the entire axial height of the perforated disk. This simplifies the buildup of several electroplated layers, which takes place consecutively over time. However, the disadvantage of this is that no information revealing the outline of the perforated disk can be derived externally from the perforated disk.

European Patent No. 567 332 and German Patent No. 44 32 725 also describe microplated components that are produced by a similar technology. Viewed from the outside, the finished components in this case do not reveal any information on the layout, structure, or any other parameters of the components.

SUMMARY OF THE INVENTION

The component according to the present invention has an advantage that information about the layout and outline of the component can be easily obtained. To do this, code marks which can be very easily evaluated and decoded through optical or other means are provided while microplating the component, i.e. during the electroplating process, thereby making a great deal of information about the component parameters available.

The code marks can be produced, at no extra expense, during the production steps needed to achieve the desired component geometry, e.g. the aperture geometry of a perforated disk through which a fluid flows. A code mark is produced out of the way of the essential contours needed for performing the component functions in the very same manner as other aperture areas. The code marks are advantageously formed during the first electroplating step by using photolithography masks. As a result, the code marks are positioned from the very beginning on a side of the component forming an outer edge.

It is especially advantageous to combine several code marks into a code field. This can easily increase the amount of information contained in the encrypted code marks to a considerable degree. The code marks are advantageously provided in binary code, i.e. recesses and filled-in metal areas (voids) correspond to the numbers 0 and 1, thereby forming a binary code which can be very easily decoded.

DETAILED DESCRIPTION

Figure 1A:
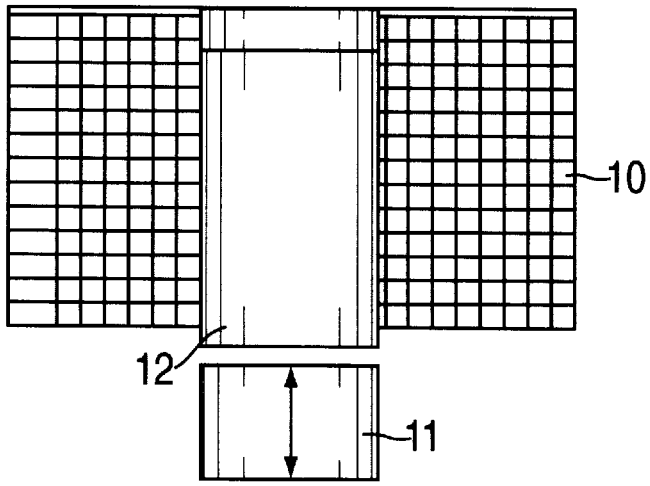
FIG. 1*a* shows a partially illustrated injection valve with a microplated component in the form of a perforated disk.
Figure 1B:
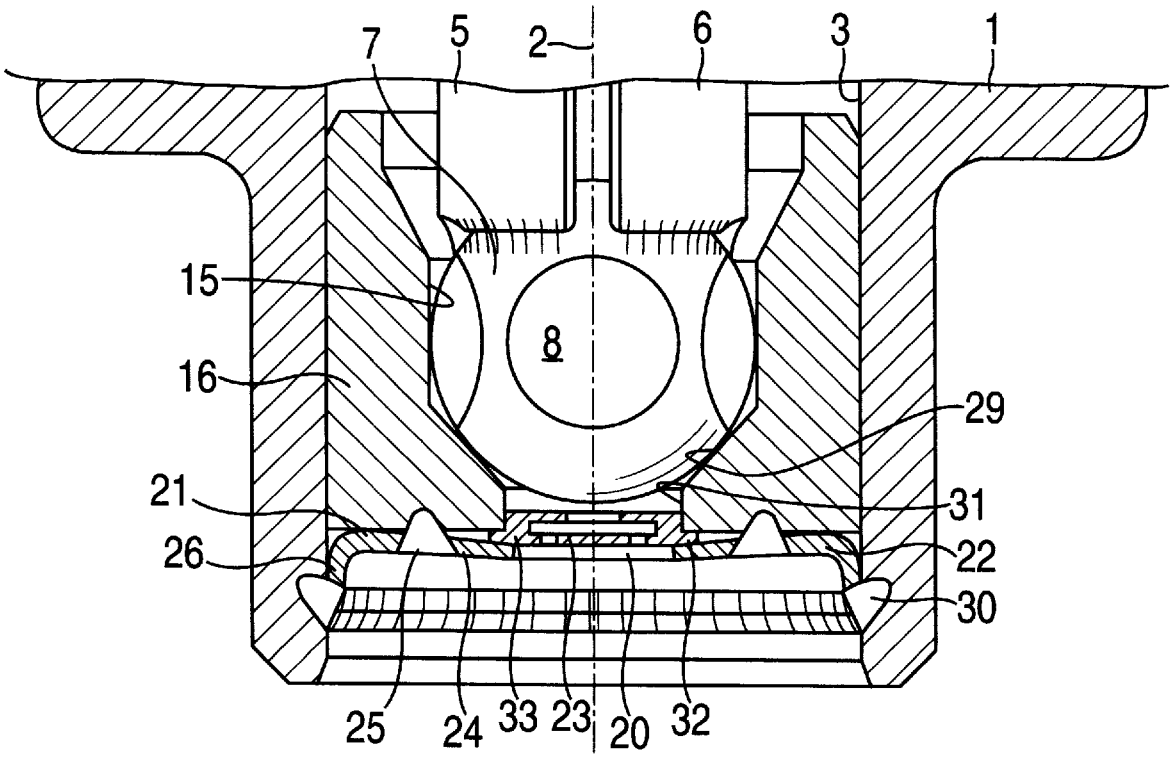
FIG. 1*b* shows another view of the injection valve.

FIG. 1*b* shows a partial view of a valve in the form of an injection valve for fuel injection systems of mixturecompression internal combustion engines with externally supplied ignition having a perforated disk 23 which represents an exemplary embodiment of a microplated component according to the present invention. At this point, it should be noted that perforated disks 23 described in greater detail below are not intended exclusively for use in injection valves; instead, they can also be used, for example, in paint nozzles, inhalers, ink-jet printers or freeze-drying processes, for spraying or injecting fluids such as drinks, or for atomizing medicines. Perforated disks 23 produced by multilayer electroplating are generally suitable for generating fine sprays, e.g. those with wide angles.

Perforated disks 23 themselves represent only one a exemplary embodiment of a microplated component. Microplated components with shapes, contours, size ratios, and applications that are entirely different from those of perforated disks 23 described can, be designed according to the present invention, which is therefore not limited to perforated disks 23.

The injection valve partially illustrated in FIG. 1 has a tubular valve seat support 1*b*, in which a slot 3 is formed concentrically to a longitudinal valve axis 2. For example, in slot 3 there is provided a tubular valve needle 5, the downstream end 6 of which is connected to a spherical valve closing member 7, with five flat areas 8, for example, to allow the fuel to pass being provided around its circumference.

The injection valve is operated in a conventional manner, for example though electromagnetic means. An electromagnetic circuit (represented schematically) with a magnetic coil 10, an armature 11, and a core 12 is (shown in FIG. 1*a*) used to move valve needle 5 in an axial direction, thereby opening a resetting spring (not illustrated) against the spring resistance or to close the injection valve. Armature 11 is connected to the end of valve needle 5 facing away from valve closing member 7, e.g. by a welded seam produced by a laser, and aligned with core 12.

A guide opening 15 of a valve seat member 16, which is mounted in a leak-proof manner by welding in slot 3 in the downstream end of valve seat support 1, is used to guide valve closing member 7 during the axial movement. Valve seat member 16 is connected concentrically and permanently to a perforated disk support 21, designed, for example, in the shape of a pot, which thus lies directly against valve seat member 16, at least in an outer ring area 22.

A component designed according to the present invention, perforated disk 23 in this case, is arranged upstream from a through hole 20 in perforated disk support 21 so that it completely covers through hole 20. Perforated disk support 21 is designed with a bottom part 24 and a retaining edge 26. Valve seating member 16 and perforated disk support 21 are connected, for example, by a circumferential, leak-proof first welded seam 25 produced by a laser. Perforated disk support 21 is also connected to the wall of slot 3 in valve seat support 1 in the area of retaining edge 26, for example by a circumferential and leak-proof second welded seam 30.

Perforated disk 23, which can be clamped between perforated disk support 21 and valve seating member 16 in the area of through hole 20 within circular welded seam 25, is designed in layers, for example. An upper perforated disk region 33 with a diameter smaller than a base region 32, fits into a cylindrical outlet 31 of valve seating member 16 downstream from a valve seat area 29 tapering like a truncated cone. Base region 32 of perforated disk 23, which projects radially above perforated disk area 33 and thereby can be clamped, rests against valve seat member 16. While perforated disk region 33 encompasses two working layers of perforated disk 23, for example, namely a middle and a top working layer, a single bottom working layer forms base region 32. As a result, one working layer should always have a largely uniform aperture contour along its axial length.

The use of perforated disk 23 with a perforated disk support 21 and a clamping mechanism for attachment is only one possible method of attaching perforated disk 23 downstream from valve seat area 29. Since the attachment options are not essential to the present invention, only conventional joining methods are being referred to herein, such. as welding, soldering, or gluing, which can also be used to attach perforated disk 23.

Perforated disks 23 illustrated in FIGS. 2 through 5 are constructed in several metal working layers by electrodeposition (multilayer electroplating). The depth lithography electroplating technique provides special outlining features, such as:

- working layers of a uniform thickness across the disk surface,
- largely vertical incisions in the working layers, due to depth lithographic structuring, which form the cavities through which the fluid flows (deviations of approx. 3° from optimally vertical walls may occur depending on the production technology),
- desired undercutting and overlapping of the incisions due to the multilayer construction of individually structured metal plates,
- incisions with any cross-sectional shape having walls that are largely parallel to the axis,
- one-piece design of the perforated disk, since the individual depositions follow one another directly.

Described below is a brief definition of terms, since the terms "plate" and "working layer". A working layer of perforated disk 23 is a layer along the axial length of which the contour remains largely constant, including the arrangement of all openings in relation to one another and the geometry of each individual opening. A plate, on the other hand, is defined as a layer of the perforated disk built up during a single electroplating step. However, a plate can have several working layers which are produced, for example, by what is known as lateral overgrowth. During a single electroplating step, several working layers (e.g. the middle and top working layers of a perforated disk 23 having three working layers) are formed which represent a cohesive plate. As mentioned above, however, the various working layers have different aperture contours (inlets, outlets, channels) in relation to the directly following working layer. The individual plates of perforated disk 23 are electrodeposited consecutively so that the subsequent plate adheres firmly to the underlying plate due to electrical bonding, and all plates together then form a one-piece perforated disk (23).

The paragraphs below only briefly explain the method for producing perforated disks 23 according to FIGS. 1 through 5. All steps in the electrodeposition method for producing a perforated disk can be found in German Patent No. 196 07 288. Due to the high demands placed on the structural dimensions and the precision of injection nozzles, microstructuring methods are currently becoming more and more important for large-scale production of these parts. In order for the fluid, e.g. the fuel, to flow, a channel which encourages the formation of turbulence within the flow, as discussed earlier, must be provided within the nozzle or the perforated disk. Characteristic of the method which successively applies photolithography steps (UV depth lithography), with subsequent microplating, is the fact that highly precise structures are achieved even on a large scale, making the method ideal for use in extremely large-volume mass production. A large number of perforated disks 23 can be produced on a wafer simultaneously.

The method begins with a flat and stable wafer, which can be made of metal (titanium, copper), silicon, glass, or ceramic, for example. Optionally, at least one auxiliary plate is initially electroplated onto the wafer. This, for example, is a starting plate (e.g. Cu), which is needed to provide electrical conduction for the later microplating step. The starting plate can also be used as a sacrificial plate, making it possible to easily separate the perforated disk structures by etching later on. The auxiliary plate (typically CrCu or CrCuCr) is applied, for example, by sputtering or by electroless deposition. This wafer pretreatment is followed by the application of a photoresist over the entire surface of the auxiliary plate.

The photoresist should have the same thickness as the metal plate to be created during the later electroplating process, i.e. the thickness of the bottom plate or working layer of perforated disk 23. The metal structure to be created is transferred as a negative in the photoresist using a photolithography mask. One option is to expose the photoresist directly via the mask by exposure to UV light ( UV depth lithography).

The negative structure finally produced in the photoresist for what is to become the working layer of perforated disk 23 is electrically filled in with metal (e.g. Ni, NiCo) by electrodeposition. Electroplating causes the metal to adhere closely to the contour of the negative structure, so that the predefined contours are reproduced in the metal true to shape. To create the structure of perforated disk 23, the steps must be repeated from the optional application of the auxiliary plate, depending on the number of plates desired, with two working layers, for example, being produced in a single electroplating step (lateral overgrowth). Different metals can also be used for the plates of a perforated disk 23; however, each one can be used only in a new electroplating step. In the end, perforated disks 23 are separated. This is done by etching away the sacrificial plate, which causes perforated disks 23 to lift away from the wafer. The starting plates are then etched off and the remaining photoresist removed from the metal structures.

Figure 2:
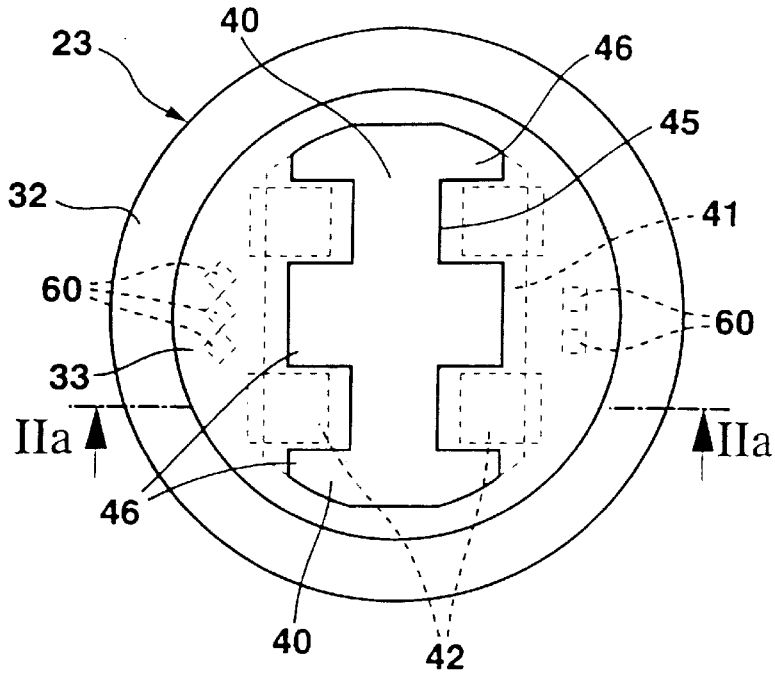
FIG. 2 shows a top view of a first perforated disk.
Figure 2A:
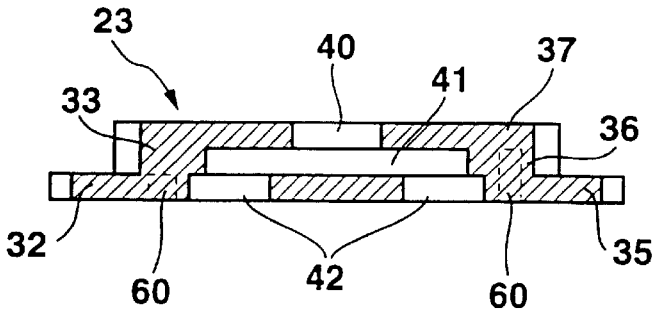
FIG. 2*a* shows a cross-section of a perforated disk along line IIa—IIa of FIG. 2.

FIG. 2 shows the top view of an exemplary embodiment of a perforated disk 23. Perforated disk 23 is designed as a flat, circular component which has several, for example three, working layers arranged consecutively along the axis. FIG. 2*a*, in particular, which is a cross-sectional representation along a line IIa—IIa in FIG. 2, demonstrates the structure of perforated disk 23 with its three working layers, bottom working layer 35 (constructed first and corresponding to the first deposited layer, or base region 32, of perforated disk 23) having a larger outer diameter than the two subsequent working layers 36 and 37, which together form perforated disk region 33 and are produced, for example, in a single electroplating step. Top working layer 37 has an inlet 40 with a relatively large circumference having a contour resembling a stylized bat (or a double H). Inlet 40 has a cross section which can be described as a partially rounded rectangle with two pairs of opposing, rectangular constrictions 45 and three inlet regions 46 projecting beyond constrictions 45. Four rectangular outlets 42 are provided in bottom working layer 35, for example at an equal distance from longitudinal valve axis 2 and therefore from the central axis of perforated disk 23, and also arranged symmetrically around the perforated disk. After projecting all working layers 35, 36, 37 onto a plane, rectangular/square outlets 42 lie partially or almost entirely in constrictions 45 of top working layer 37 and are offset in relation to inlet 40. The offset can vary in size in different directions.

To allow a fluid to flow from inlet 40 to outlet 42, a channel 41 representing a cavity is provided in middle working layer 36. Channel 41 having the contour of a rounded rectangle is large enough to completely cover inlet 40 in the projection and, especially in the regions of constrictions 45, to noticeably project beyond inlet 40, i.e. it is positioned at a greater distance from the central axis of perforated disk 23 than constrictions 45.

A number of code marks 60 are provided in the areas between central inlet regions 46 of inlet 40 and the outer edge of base region 32 or perforated disk region 33 of perforated disk 23. In the exemplary embodiment according to FIG. 2, individual code marks 60 have essentially square contours. Code marks 60 can be arranged individually or in groups, with code marks 60 arranged in groups together forming more complex code marks 60 and being referred to as code fields. In FIG. 2, three code marks 60,which touch each other by one corner, are arranged on one side next to inlet 40 and form a complex (code field), while two code marks 60, positioned close to one another so that the facing edges of code marks 60 run parallel to one another, are arranged on the other side next to inlet 40.

Using masks, recesses are provided during electroplating in bottom working layer 35 (which is the first layer to be deposited) in addition to outlets 42 in order to produce code marks 60. These recesses, which serve as code marks 60, can be produced at no additional expense during the production steps needed in order to produce the desired aperture geometry. The production of code marks 60 is identical to the production of outlets 42. Second working layer 36, which is produced, for example, in a subsequent electroplating step, covers the recesses, e.g. toward the top, so that the depth of code marks 60 corresponds to the thickness of bottom working layer 35 (on the left of FIG. 2*a*). This ensures that no fluid can flow into code marks 60 from inlet 40, thereby preventing impairment of the perforated disk function. Code marks 60 are visible in the form of indentations on the bottom face of perforated disk 23 and can be scanned without contact using conventional technologies and evaluated, for example using optical means.

As shown in FIG. 2*a*, individual code marks 60 can extend to more than one working layer 35 at any time. While code mark 60 on the left side is only as deep (or high) as working layer 35, code mark 60 on the right side is intended to show that it extends, for example, into two working layers 35 and 36, since code mark 60 representing an indentation was not covered by top working layer 37 until a subsequent electroplating step. Express note should be taken of the fact that the provision of code marks 60 from bottom working layer 35 is only one advantageous possibility, while all other sides of the component, a perforated disk 23 in this case, which form an outer edge are also suitable for this.

Code marks 60, which are designed, for example, in the shape of a square, have edges that are 100 to 200 $\mu$m long, for example. For structural reasons, the smallest controllable cross-sectional dimension of a code mark 60 is equal to the structural height or depth of code mark 60, which corresponds to the thickness of the photoresist film. Code marks 60 can be used to encrypt a large amount of information about the outline of perforated disk 23, making it possible to eliminate identification with numbers and letters, which is more expensive and takes up much more space. The information is provided, for example, in a binary code. For example, if a code mark 60 in a code field is filled with metal, this can represent the value 0, while a code mark 60 provided in the form of a recess represents the value 1. A complex code field formed from these two code marks 60 can therefore be read as 01 or 10. A recess or a filled-in code mark 60 can, of course, also be defined in the opposite sense. Considerably more information can be encrypted each time a code mark 60 is added to a code field or by adding more code fields. Code fields can be composed of spaced or adjacent code marks 60.

Figure 3:
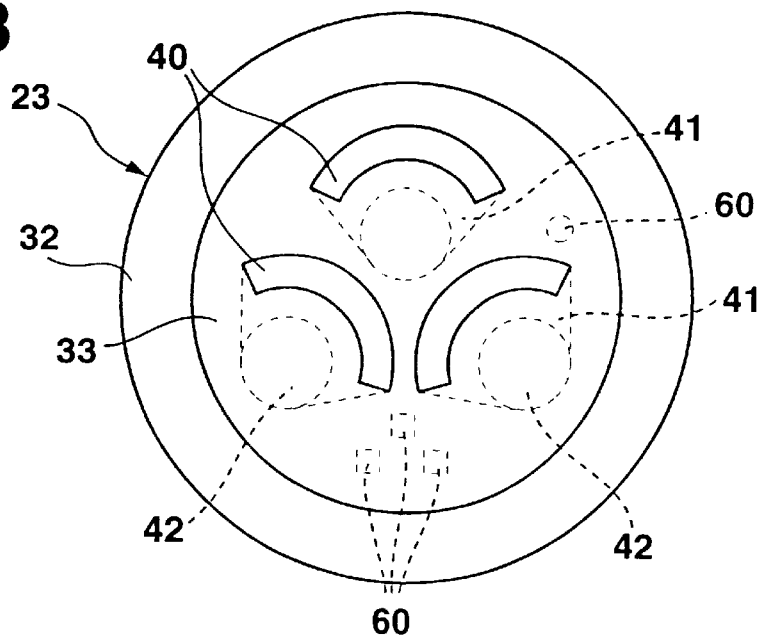
FIG. 3 shows a top view of a second perforated disk.

FIG. 3 shows a perforated disk 23 which has several, for example three, inlets 40. Each inlet 40 is assigned to only one channel 41 and only one outlet 42. This type of perforated disk 23 is very useful insofar as it can be used to produce very unusual jet patterns. Perforated disk 23 has three functional units, each with one inlet 40, one channel 41, and one outlet 42. Depending on the desired jet pattern, the functional units are arranged asymmetrically or eccentrically around longitudinal valve axis 2, which is always the central axis of perforated disk 23. Individual jet directions can be effectively achieved with this seemingly random distribution. In the perforated disk according to FIG. 3, a channel 41 with a cross-sectional semicircular contour connects a sickle-shaped or arc-shaped inlet 40 to a circular outlet 42. Channels 41 always completely run beneath or cover inlets 40 and outlets 42 assigned to them. Outlets 42 are arranged so that the jet pattern forms an asymmetrical cone, since the individual jets diverge, i.e. they are aimed in an increasingly wider angle in a main direction obliquely to longitudinal valve axis 2.

Perforated disk 23 according to FIG. 3 has a code field with three square code marks 60, arranged at a distance from one another in a triangle, and a circular code mark 60, which are all positioned at points on perforated disk 23 where they will not impair the actual basic functions of perforated disk 23. This is usually in edge regions out of the way of outlets 42. In addition to the square and round contours for code marks 60, triangular, rectangular, oval and other cross-sections are also conceivable.

Figure 4:
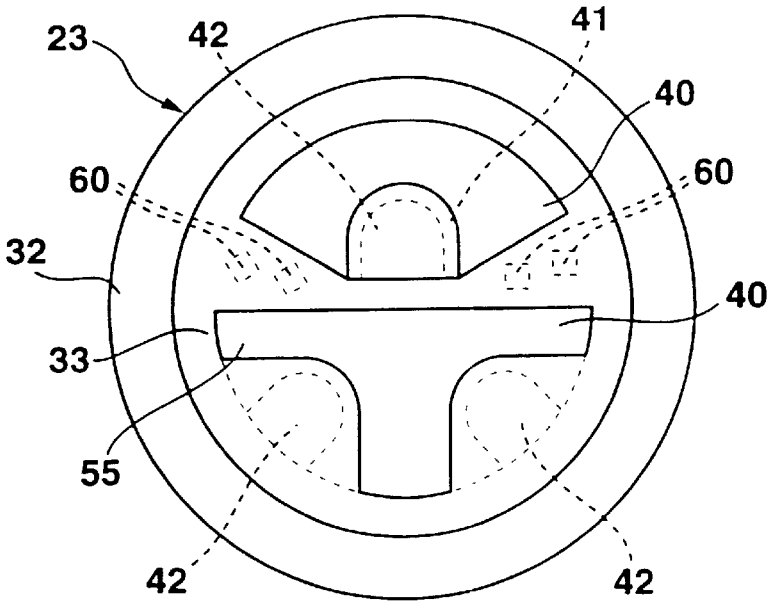
FIG. 4 shows a top view of a third perforated disk.

FIG. 4 shows a further exemplary embodiment of a perforated disk 23 with several inlets 40 (two in this case). The two inlets 40 have completely different aperture contours, since these perforated disks 23 are also intended for use in producing oblique jets or asymmetrical jet patterns. While one inlet 40 has three arms 55, thereby forming a T, second inlet 40 has the shape of an arc which varies in width. The three outlets 42, which are shaped, for example, like a tunnel entrance one of which is assigned to arc-shaped inlet 40 and the semicircular channel 41 connected to them and two of which are assigned to T-shaped inlet 40 and downstream semicircular channel 41 are embedded in the areas between inlet arms 55 or in the cavity enclosed by the arc shape of the one inlet 40.

In the area between the two inlets 40, two code fields, for example, each with two spaced code marks 60, are positioned in bottom working layer 35 (base region 32). Also these code marks 60 have square contours, for example, and can be aligned with different points along the individual edges of the aperture contours. For example, two edges of code marks 60 run along the right side in FIG. 4, parallel to a limiting edge of T-shaped inlet 40, while code marks 60 on the left side do not have an edge running parallel to the limiting edges of inlets or outlets 40, 42.

Figure 5:
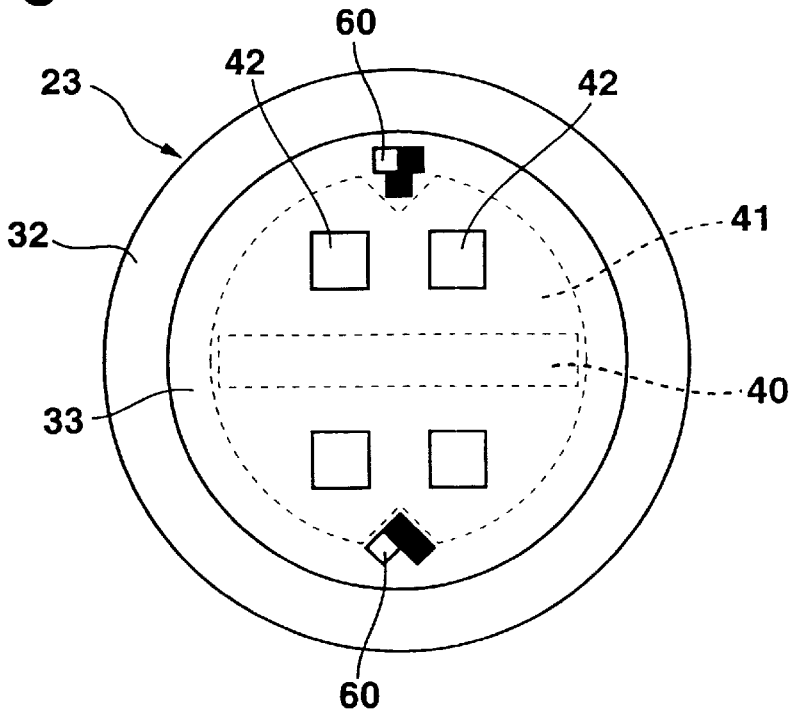
FIG. 5 shows a bottom view of a fourth perforated disk.

FIG. 5 shows a bottom view of a perforated disk 23, which has an extended rectangular inlet 40 and four square outlets 42 distributed more or less evenly across the perforated disk surface. Channel 41 in middle working layer 36 has a more or less circular contour, which has V-shaped notches at two opposite points. In the projection of all the working layers of perforated disk 23, channel 41 completely covers inlet 40 and outlets 42.

Code marks 60, for example, are positioned in the notches in channel 41. The two code fields are arranged in the shape of a T or a V and are each composed of three square code marks 60 in the shape mentioned above. Both code fields can be read in binary code, e.g. as 100 or 001 or, with the opposite number of recesses or filled-in regions, as 011 or 110. Individual code marks 60 can also pass through more than just one working layer 35 at any time.

Code marks 60 are usually scanned through non-contact means. A number of different methods can be used for scanning and subsequently evaluating the information encrypted in code marks 60. For example, an optical evaluation using conventional CCD camera, for example, can be carried out, with this application having a computer-supported pattern recognition and evaluation capability. An optical evaluation method via laser scanning in order to detect indentations is also conceivable. Echo depth sounding methods with ultrasound or scanning using an infrared camera are other possibilities.

What is claimed is:

1. A microplated component having a three-dimensional structure produced by a depth lithography procedure, comprising:

at least one scannable code mark produced during an electroplating procedure, the at least one scannable code mark situated along a side of the microplated component forming an outer edge.

2. The microplated component according to claim 1, wherein the at least one scannable code mark is one of a recess area and a predefined filled-in metal area.

3. The microplated component according to claim 2, wherein the at least one scannable code mark representing the recess area has a depth, the depth being equal to a plate thickness of the three-dimensional structure of the microplated component deposited in a first electroplating step of the electroplating procedure.

4. The microplated component according to claim 1, wherein the at least one scannable code mark includes a plurality of scannable code marks, the plurality of scannable code marks combined together to form a code field.

5. The microplated component according to claim 4, wherein one of the plurality of scannable code marks is spaced from another one at a preselected distance.

6. The microplated component according to claim 4, wherein one of the plurality of scannable code marks contacts another one.

7. The microplated component according to claim 6, wherein the plurality of scannable code marks are arranged in a form of complex code fields in one of a T shape and a V shape.

8. The microplated component according to claim 1, wherein the at least one scannable code mark has one of: square cross-sections, rectangular cross-sections, triangular cross-sections, oval cross-sections and circular cross-sections.

9. The microplated component according to claim 1, wherein information about the three-dimension structure and outlining of the microplated component is encrypted in the at least one scannable code mark.

10. The microplated component according to claim 1, wherein the at least one scannable code mark is evaluated using one of an optical arrangement and an ultrasound device.

* * * * *